US006474571B2

(12) United States Patent
Schmit et al.

(10) Patent No.: US 6,474,571 B2
(45) Date of Patent: Nov. 5, 2002

(54) DEVICE FOR TREATING SHEET MATERIALS USING PRESSURIZED WATER JETS

(75) Inventors: Laurent Schmit, Saint Martin d'Heres (FR); Bruno Roche, Voglans (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 09/996,110

(22) Filed: Nov. 28, 2001

(65) Prior Publication Data

US 2002/0134866 A1 Sep. 26, 2002

Related U.S. Application Data

(63) Continuation of application No. PCT/FR00/01398, filed on May 22, 2000.

(30) Foreign Application Priority Data

Jun. 17, 1999 (FR) ..... 99 07885

(51) Int. Cl.[7] ..... B05B 1/14
(52) U.S. Cl. ..... 239/553.3; 239/597
(58) Field of Search ..... 239/553, 553.3, 239/553.5, 566, 568, 597, 104–106, 162; 28/103, 105

(56) References Cited

U.S. PATENT DOCUMENTS

| | | | | |
|---|---|---|---|---|
| 3,214,819 A | | 11/1965 | Guerin | 28/72.2 |
| 3,485,706 A | | 12/1969 | Evans | 161/72 |
| 3,508,308 A | | 4/1970 | Bunting, Jr. et al. | 28/72.2 |
| 3,613,999 A | | 10/1971 | Bentley et al. | 239/553.3 |
| 5,042,722 A | | 8/1991 | Randall, Jr. et al. | 239/553.5 |
| 5,054,349 A | | 10/1991 | Vuillaume | 83/177 |
| 5,806,155 A | * | 9/1998 | Malaney et al. | 28/104 |

OTHER PUBLICATIONS

Database WPI, Section Ch. Week 199443, Derwent Publications Ltd., London, GB; Class F04, AN 1994–347857 XP002134154 & KR 9 311 631 b (Choe Y), Dec. 16, 1993.

* cited by examiner

*Primary Examiner*—Lisa A. Douglas
(74) *Attorney, Agent, or Firm*—Heslin Rothenberg Farley & Mesiti P.C.; Philip E. Hansen; Victor A. Cardona, Esq.

(57) ABSTRACT

A mechanism for the treatment of materials by pressurized water jets includes a body (1) for supplying water under pressure which includes a feeding chamber (2) extending over the whole length of the body, and wherein water under pressure is fed to the feeding chamber through a filter (4). The body also includes a distributing zone for distributing water under pressure over a whole treatment length against a plate (7) provided with micro-perforations which define water needles (8) directed against the surface (S) of the material to be treated. The material is supported by a carriage element subjected to a suction source eliminating the treatment water. Further, water transfer from the intake chamber (2) to the perforated plate (7), is done through a channel (22) with a rectangular cross-section extending over the whole length of the injector, from the periphery of the feeding chamber (2) up to the surface or the perforated plate (7), wherein the spacing between the side walls (21) of the channel and the height thereof produces a unidirectional and stable stream of water without turbulence.

8 Claims, 2 Drawing Sheets

DEVICE FOR TREATING SHEET MATERIALS USING PRESSURIZED WATER JETS

CROSS REFERENCE TO RELATED APPLICATIONS

This application is a continuation of International Application PCT/FR00/01398, filed May 22, 2000, which claims the priority of French application 99 07885, filed Jun. 17, 1999, the entireties of which are hereby incorporated herein by reference.

TECHNICAL FIELD

The present invention relates to an improvement made to plants used for treating sheet materials by means of pressurized water jets, which act on the structure in the manner of needles, the latter being used in particular for treating nonwoven structures for the purpose of giving them cohesion and/or modifying their appearance.

Such a technique, which has been used for decades, as is apparent for example from patents U.S Pat. Nos. 3,214,819 and 3,485,706, consists in subjecting the sheet structure to the action of water jets coming from one or more successive injector rails, the web being supported by a porous or perforated conveyor belt or rotating roll, said belt or roll being subjected to a suction source allowing the water to be recovered.

One of the essential elements of such plants is the system for forming the water jets or needles, this commonly being referred to by the expression "injector".

The invention relates more particularly to a novel type of injector.

PRIOR ART

The injectors used at the present time may be produced specifically in accordance with the teaching of FIG. 42 of patent U.S. Pat. No. 3,485,706 and of the corresponding passages from the description of that document, and the much more detailed specific embodiments appearing for example in patent U.S Pat. No. 3,613,999 and in EP 400 249 (corresponding to U.S. Pat. No. 5,054,349), the latter document describing a type of injector which not only makes it possible to inject water at a very high pressure (greater than 100 bar) but has a structure such that it allows the perforated plate, through which the microjets pass, to be easily fitted and removed.

Referring to the appended FIG. 1, such injectors are therefore in general in the form of a continuous injector rail which extends transversely with respect to the direction of movement of the sheet material (F), for example a nonwoven, to be treated and the length of which is matched to the width of the said material. This injector rail may consist of a single individual module or a plurality of mutually juxtaposed modules.

Such an injector rail is composed of a main body (1) which can withstand any deformation due to the water pressure and in the upper part of which there is a chamber (2), in general of cylindrical shape, fed with pressurized water through a pipe (3) supplied via a pump (not shown). Placed inside the chamber (2) is a cartridge (4) consisting, for example, of a perforated cylinder lined with a filter cloth which not only acts as filter but also as distributor.

The pressurized water fed into the chamber (2) then flows through cylindrical holes (5) which are separated with a regular pitch over the entire width of the injector, the diameter of which holes is in general between 4 mm and 10 mm and the thickness of the wall between two consecutive holes being around 3 to 5 mm.

These cylindrical holes (5), the outlet end of which may possibly be of conical shape, then emerge in a lower chamber (6) at the base of which a plate (7) provided with microperforations is positioned, the diameter of the microperforations of which may be between 50 and 500 $\mu$m and preferably between 100 and 200 $\mu$m, making it possible to form water jets or needles (8) which act directly against the surface of the material (F) to be treated, for example a nonwoven web.

The perforated plate (7) is held against the main body of the injector by, in accordance with the teaching of EP 400 249 for example, longitudinal jaws (9) subjected to the action of hydraulic cylinders which allow a clamping action to be exerted by means of a system of cross bars and pull rods placed along the injector.

A seal (not shown) is placed between the perforated plate (7) and the base of the main body (1).

Such a system for distributing pressurized water against the microperforated plate intended to form the water needles, and which therefore makes use of holes (5) emerging in a lower chamber (6), makes it possible to distribute the water correctly over the entire length of the injector, the same amount of water passing through each orifice.

However, it has been found that such a solution, especially in the case of the treatment of nonwoven webs, can result in defects in the treated product when the water pressure in the injector exceeds 50 bar.

FIG. 2 illustrates schematically the reasons for such defects.

This figure shows that, when the water feed pressure inside the cylindrical bore (2) is increased, this being essential when it is desired to increase production rates and/or treat heavy products, areas of turbulence are produced in the lower chamber (6) in those regions (10) lying immediately below the walls separating two consecutive holes (5). Such turbulence is transmitted to the water jets, resulting in a substantial and rapid reduction in their energy, the jets (J1) becoming diffuse and whitish beneath the said areas of turbulence, whereas under the holes (5) the flow from the jets (J2) remains unidirectional, stable and turbulence-free.

During the treatment of nonwoven webs, such a disparity in flow has immediate repercussions on the effectiveness of fiber bonding and makes the entanglement of the fibers in the product heterogeneous, particularly with a variation in density.

Consequently, as shown schematically in FIG. 1, low-density bands (B) are obtained on the finished product, these bands being very irregular surfacewise and coinciding exactly with the turbulent flow regions between the holes.

SUMMARY OF THE INVENTION

An improvement to such a type of injector has now been found, and it is this which forms the subject of the present invention, which makes it possible to solve this problem and allows water to be supplied with a high pressure, possibly reaching 400 bar or more, and which makes it possible to obtain a stable and turbulence-free flow of pressurized water between the pressurized-water feed chamber and the perforated plate for forming the treatment jets or needles, the said jets being perfectly homogeneous and all having the same action on the product to be treated.

In general, the injector according to the invention, therefore allowing the treatment of a sheet material (nonwoven, textile complex, film, paper, etc.) by means of water jets/needles, comprises:

a body for supplying pressurized water, comprising a feed chamber which extends over the entire length of said body and inside which the pressurized water is taken through a filter;

a distribution region, distributing the pressurized water over the entire treatment width against a plate provided with microperforations, the holes of which define water needles directed against the surface of the material to be treated, said material being supported by a transporter element (drum or conveyor belt) subjected to a suction source allowing the treatment water to be removed, and it is characterized in that the water is transferred from the feed chamber to the perforated plate via a channel of rectangular cross section extending over the entire length of the injector, from the periphery of the feed chamber to the surface of the perforated plate, the separation between the side walls of this channel and its height producing a unidirectional, stable and turbulence-free flow of water.

To obtain such laminar flow of the pressurized water, the space between the two side walls defining the distribution channel is advantageously between 2 mm and at most 10 mm, the height of the walls being between 5 mm and 100 mm and the jets produced by the microperforations having, thanks to such a structure, an identical output energy over the entire treatment width.

BRIEF DESCRIPTION OF THE DRAWINGS

The invention and the advantages that it affords will, however, be more clearly understood thanks to the illustrative example given below by way of indication, but implying no limitation, and illustrated by the appended drawings in which.

as indicated previously.

MANNER OF REALIZING THE INVENTION

Figure 1:
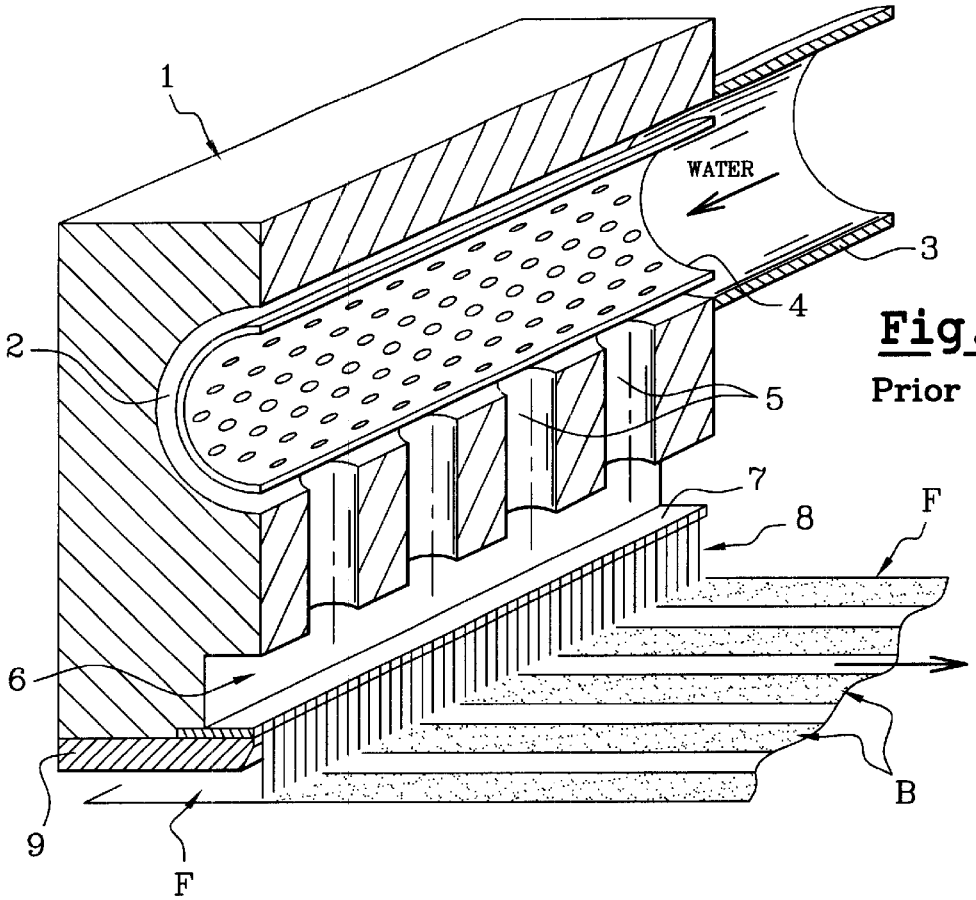
Fig. 1 Prior Art
FIG. 1 illustrates, schematically, seen in cross section in its vertical plane of symmetry, the structure of an injector according to the prior art, FIG. 2 illustrating, schematically, the turbulence and formation of irregular jets that arise when the pressure of the water fed into the body of the injector is increased.
Figure 2:
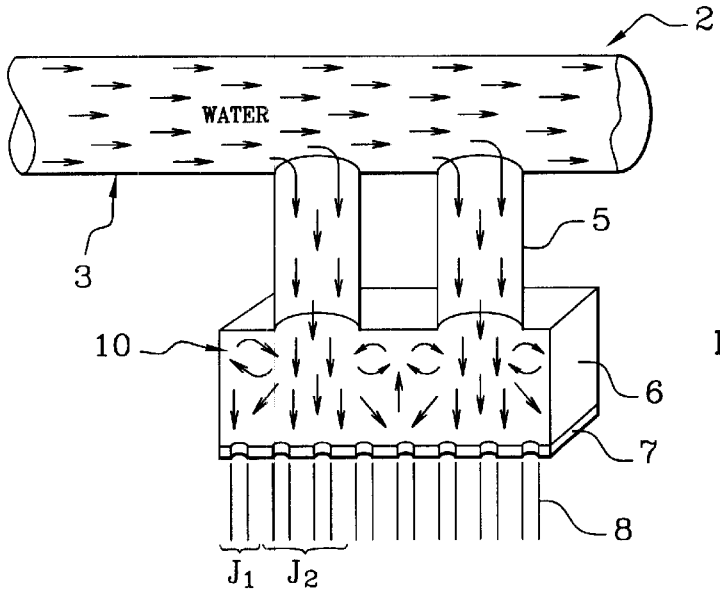
Fig. 2 Prior Art
Figure 3:
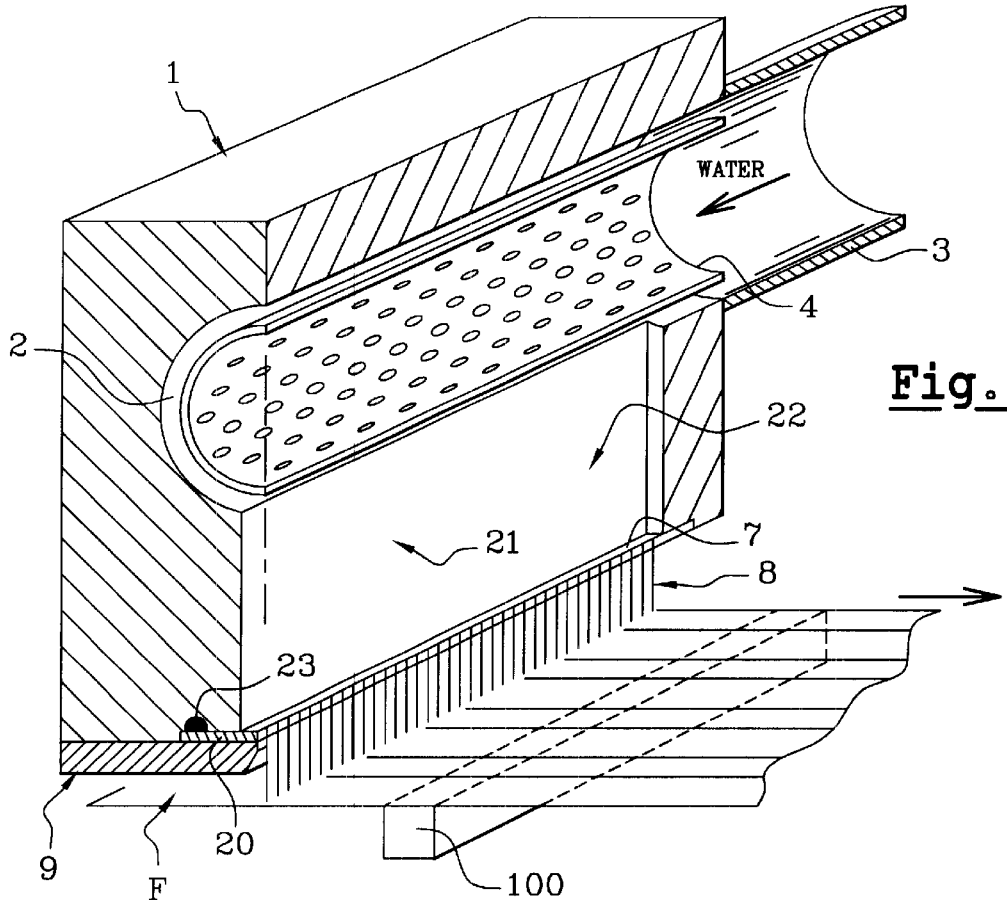
FIG. 3 also illustrates, schematically, in perspective and in cross section in its vertical plane of symmetry, the overall structure of an injector designed according to the invention.

Referring to the appended FIG. 3, and using the same reference numbers for the common elements as those used to describe the prior art illustrated in FIG. 1, the injector according to the invention is composed, in a manner similar to that of the prior art, of a steel main body (1) having a length of 3500 mm, a total width of 200 mm and a height of 200 mm.

Produced in the upper part of this body is a cylindrical chamber (2) having a diameter of 70 mm. This chamber is fed with pressurized water through a pipe (3).

In the appended figure, the water is illustrated as entering from the side, but it could also enter via the top of the body or the rear.

Inside the bore (2) there is a cartridge (4) consisting of a perforated cylinder lined with a filter cloth.

Fixed to the base (20) of this upper body, for example by means of lateral jaws (9), is a microperforated plate (7) formed, in the present case, by a steel strip having a thickness of 1 mm and a width of 25 mm and containing at least one row of orifices, the diameter of which is preferably between 100 and 200 $\mu$m and which in general are separated by an inter-hole distance of between 0.6 and 1.2 mm.

Sealing means, for example seals (23), are of course provided between the base (20) of the upper body and the surface of the microperforated plate (7).

A sheet material F to be treated is located on a transporter element (e.g., a drum or conveyor belt) below plate 7 such that sheet material F may receive water jets from plate 7 to treat material F. Also, a suction source 100 is located below sheet material F to allow the water to be removed from the bottom of sheet material F.

In accordance with the invention, transfer of the pressurized water to the plate (7) for forming the water jets takes place through a channel (22) extending from the periphery of the chamber (2) to the surface of the microperforated plate (7). This slit channel consists of two parallel opposed walls (21) separated from each other by a distance of between 1 mm and at most 10 mm, the height being between 5 mm and 100 mm. This slit channel is closed laterally.

Figure 4:
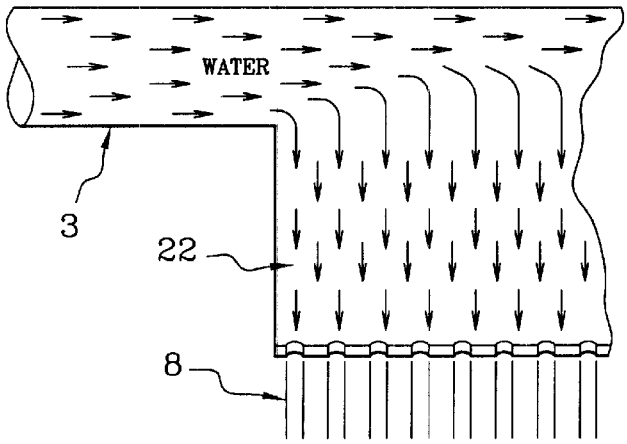
FIG. 4 is a schematic view of the flow of pressurized water inside an injector produced according to the invention.

Thanks to this novel construction, and as illustrated in FIG. 4, a laminar flow of the pressurized water is obtained, without any turbulence, as is apparent from FIG. 4, the jets (8) produced by the orifices in the plate (7) all having the same energy.

To illustrate the advantages afforded by the invention, comparative trials were carried out on a machine of the Applicant's "Jetlace 2000" type, said machine being provided with injectors produced according to the prior art as illustrated in FIG. 1 for one series of trials and with injectors produced in accordance with the invention for a second series of trials, carried out under the same water-pressure conditions.

In these comparative trials, the injectors of the prior art, as illustrated in FIG. 1, had the following characteristics:

| | |
|---|---|
| diameter of the upper chamber (4): | 50 mm |
| diameter of the ducts (5): | 6 mm |
| distance between two consecutive ducts (5): | 10 mm |
| height of the ducts (5) : | 35 mm |
| height of the lower chamber (6): | 10 mm |

the microperforated plate having a single row of 120 $\mu$m microperforations separated from one another by 0.6 mm.

The other series of trials was carried out on the same machine but with injectors made according to the invention, the upper chamber of which had the same diameter as the conventional injectors and which, compared with the latter, had a slit channel (22) over a height of 36 mm, extending from the intake chamber (4) to the microperforated plate (7), the parallel walls of which channel were separated from each other by 3 mm.

The microperforated plate also consisted of a plate having 120 $\mu$m orifices separated from one another by 0.6 mm.

In these comparative trials, a 38 mm wide nonwoven web, weighing 250 g/m$^2$, based on polyester fibers having a titer of 1.7 dtex, was treated.

This web was subjected to the action of two injectors acting in succession against the two faces of the web.

The water was fed into the upper chamber of each type of injector, the feed pressure being gradually increased.

It was found that, for the same run speed of the nonwoven fabric beneath the treatment jets, up to a pressure of around 50 bar, the products obtained with each type of injector exhibited good homogeneity and comparable mechanical properties.

By contrast, above 50 bar, using a conventional injector as illustrated in FIG. 1, bonding defects appeared on the product formed, which defects increased when the pressure increased and resulted in the formation of irregular parallel bands, as illustrated in FIG. 1.

However, the injector according to the invention allowed a perfectly bonded web to be obtained, without any visible defects, for a feed pressure that could be up to 400 bar.

Consequently, it may be conceivable, thanks to the device according to the invention, either to increase the production rates without degrading the characteristics of the product or to treat much thicker webs, or even different types of complexes, for which conventional injectors cannot be used.

What is claimed is:

1. A device for the treatment of sheet materials by means of water jets, said device comprising:

a body (1) for supplying pressurized water, said body comprising a feed chamber (2) which extends over the entire length of said body and inside which the pressurized water is taken through a filter (4);

a distribution region, distributing the pressurized water over an entire treatment width against a perforated plate (7) provided with microperforations, said microperforations defining water jets (8) directed against the surface of a material (S) to be treated, said material being supported by a transporter element subjected to a suction source allowing the treatment water to be removed, wherein the water is transferred from the feed chamber (2) to the perforated plate (7) via a channel (22) of rectangular cross section extending over an entire length of the plate, from the periphery of the feed chamber (2) to the surface of the perforated plate (7), a chamber between side walls (21) of this channel and a height of the channel producing a unidirectional, stable and turbulence-free flow of water.

2. The device as claimed in claim 1, characterized in that the space between the side walls (21) defining the channel (22) is between 1 mm and at most 10 mm, the height of the walls being between 5 mm and 100 mm.

3. A device for treatment of a sheet material by a water jet, said device comprising: a body for supplying pressurized water, said body comprising:

a feed chamber extending over an entire length of said body, said feed chamber comprising a filter for filtering water, when water is received in said feed chamber;

a perforated plate having holes for forming water jets to treat the sheet material, when water is directed against said plate;

a channel for producing a unidirectional, stable and turbulence-free flow of water, said channel comprising a top end adjacent said feed chamber, a bottom end at said plate, a left end at a left end of said body, and a right end at a right end of said plate.

4. The device of claim 3 wherein a distance between said left end of said channel and said right end of said channel comprises a dimension in a range from 1 mm to 10 mm.

5. The device of claim 3 wherein a distance between said top end of said channel and said bottom end of said channel comprises a dimension in a range from 5 mm to 100 mm.

6. A device for treatment of a sheet material by a water jet, said device comprising: a body for supplying pressurized water, said body comprising:

a feed chamber extending over an entire length of said body, said feed chamber comprising a filter for filtering water, when water is received in said feed chamber;

a perforated plate having holes for forming water jets to treat the sheet material, when water is directed against said plate;

a channel for producing a unidirectional, stable and turbulence-free flow of water, said channel consisting of a single channel chamber bounded by said feed chamber and said plate.

7. The device of claim 6 wherein said channel chamber comprises a left wall and a right wall, and wherein a distance between said left wall and said right wall comprises a dimension in a range from 1 mm to 10 mm.

8. The device of claim 7 wherein a height of said left wall and said right wall comprises a dimension in a range from 5 mm to 100 mm.

* * * * *